US007237776B1

(12) United States Patent
Ngoto

(10) Patent No.: US 7,237,776 B1
(45) Date of Patent: Jul. 3, 2007

(54) GAME BOARD

(76) Inventor: Yeme Ngoto, 1052 Sheridan Ave., apt. 4B, Bronx, NY (US) 10456

( * ) Notice: Subject to any disclaimer, the term of this patent is extended or adjusted under 35 U.S.C. 154(b) by 0 days.

(21) Appl. No.: 11/124,893

(22) Filed: May 9, 2005

(51) Int. Cl.
*A63F 3/00* (2006.01)

(52) U.S. Cl. ..... 273/242; 273/285

(58) Field of Classification Search ..... 273/242, 273/258, 285, 271
See application file for complete search history.

(56) References Cited

U.S. PATENT DOCUMENTS

| | | | | |
|---|---|---|---|---|
| 448,574 | A | 3/1891 | Richards | |
| 604,401 | A | 5/1898 | Lang | |
| 2,434,495 | A * | 1/1948 | Holton | 235/90 |
| 2,720,362 | A | 10/1955 | Champion | |
| 3,139,281 | A * | 6/1964 | Nicholson | 473/414 |
| 3,166,325 | A | 1/1965 | First | |
| 4,262,606 | A * | 4/1981 | Hodson | 108/99 |
| 4,324,406 | A | 4/1982 | Ocampo | |
| 4,569,526 | A | 2/1986 | Hamilton | |
| 4,666,160 | A | 5/1987 | Hamilton | |
| 4,854,586 | A * | 8/1989 | Morse | 273/249 |
| 5,752,336 | A | 5/1998 | Haynes | |

FOREIGN PATENT DOCUMENTS

| | | |
|---|---|---|
| GB | 476.480 | 12/1937 |

* cited by examiner

*Primary Examiner*—Vishu Mendiratta
(74) *Attorney, Agent, or Firm*—Michael I Kroll

(57) ABSTRACT

Apparatus 10 discloses a mathematically-based game comprising a game board 12 having four parallel rows of eight depressions 14 for retaining game pieces 24 such as marbles. Game pieces 24 are arranged by each player 26 in the depressions 14 which are disposed within their area of play. The players 26 then sequentially manipulate the game pieces 24 around the game board 12 according to mathematical calculations with the objective of eliminating all of the opponent's game pieces. The apparatus 10 requires the user 26 to apply addition, subtraction, thinking and reasoning thereby promoting the concentration, creativity and problem-solving abilities of the players.

2 Claims, 8 Drawing Sheets

GAME BOARD

BACKGROUND OF THE INVENTION

1. Field of the Invention

The present invention relates generally to board games and, more specifically, to a mathematically-based game comprising a game board having four parallel rows of eight depressions for retaining game pieces such as marbles. Game pieces are arranged by each player in the depressions which are disposed within their area of play. The players then sequentially manipulate the game pieces around the game board according to mathematical calculations with the objective of eliminating all of the opponent's game pieces.

The present invention requires the user to apply addition, subtraction, thinking and reasoning thereby promoting the concentration, creativity and problem-solving abilities of the players. Furthermore, the attributes of the present invention can prove useful as a learning and a therapeutic tool for children with attention deficit disorder or learning disabilities, senior citizens, people suffering from depression and other like conditions.

2. Description of the Prior Art

There are other desk attachments designed for chairs. Typical of these is U.S. Pat. No. 448,574 issued to E. H. Richards on Mar. 17, 1891.

A patent was issued to A. Lang on May 24, 1898 as U.S. Pat. No. 604,401. U.S. Pat. No. 2,720,362 was issued to W. J. Champion on Oct. 11, 1955 and a patent was issued on Jan. 19, 1965H. W. First as U.S. Pat. No. 3,166,325.

J. D. Ocampo was issued a patent on Apr. 13, 1982 as U.S. Pat. No. 4,324,406 and U.S. Pat. No. 4,569,526 was issued to C. Q. Hamilton on Feb. 11, 1986. Another patent was issued to C. Q. Hamilton as U.S. Pat. No. 4,666,160 on May 19, 1987. A patent was issued on May 19, 1998 to R. B. Haynes as U.S. Pat. No. 5,752,336.

A British patent was issued to F. H. Robertson on Dec. 9, 1937 as U.K. Patent No. 476,480.

U.S. Pat. No. 448,574

Inventor: Erwin H. Richards

Issued: Mar. 17, 1891

Game devices consisting of a board and a series of movable men, the said board having parallel rows of depressions or pockets, the pockets of one row being opposite those of the other, and each of the pockets consisting of an opening sufficiently large to receive therein several of said movable men, substantially as and for the purposes set forth.

U.S. Pat. No. 604,401

Inventor: Alexander Lang

Issued: May 24, 1898

A game device comprising a board which is divided into squares and two sets of blocks or cubes, the blocks or cubes of one set differing in color from those of the other, and each block or cube of each set being provided on each of the sides or faces thereof with a number, substantially as shown and described.

U.S. Pat. No. 2,720,362

Inventor: William J. Champion

Issued: Oct. 11, 1955

In combination with a game board having side walls with elongated grooves therealong and sockets at the ends of the grooves extending at right angles thereto, pegs mounted in said sockets, said pegs being square in cross section at their base portions, each said pegs having transverse openings through its base portions and a groove in one of its side surfaces communicating with the openings therein, each of the pegs in said sockets at one end having a groove in its opposite side surface extending partly thereacross, an elongated looped cord extending along each elongated wall groove, through the openings in the pegs and along the grooves in the side surfaces thereof, the ends of the cord being anchored in the grooves in the side surfaces extending partly across said surfaces, and indicating members slidably and removably supported on the reaches of the looped cord, said indicating members each having a rectangular-shaped body with grooves along the opposite long sides thereof loosely receiving the reaches of the cord.

U.S. Pat. No. 3,166,325

Inventor: Harry W. First

Issued: Jan. 19, 1965

A game apparatus comprising a rectangular box-like outer body member having vertical side walls, a plate-like second body member having a planar top surface fittingly disposed within said outer body member and having a central hole therein and a first series of holes disposed in Maltese cross formation, there being a plurality of holes in each reach thereof, said second body member also having a series of holes disposed radially of said central hole and centrally between and in parallel relationship.

U.S. Pat. No. 1,324,503

Inventor: Paul W. Hirsch

Issued: Dec. 9, 1919

A device of the class described comprising the combination of a supporting bracket, adapted to be secured to the side of a chair: an arm, slidable on said bracket, said arm having, on its lower surface, a pair of parallel tracks curved around a center disposed above the seat of the chair, said tracks being substantially parallel to the outer edge of said arm; and guide members, carried by said bracket and cooperating with said tracks to limit the movement of the arm to a path predetermined by the curvature of the tracks.

U.S. Pat. No. 2,165,125

Inventor: William J. Bargen

Issued: Jul. 4, 1939

In an article of furniture for the purpose se forth, a one-piece flat body formed of an enlarged part and a reduced part extended rearwardly from the latter, said enlarged part providing a desk and said reduced part constituting an arm rest, an angle bar anchored to the lower face of the desk and including a vertical flange, an upwardly and downwardly movable combined adjusting and supporting means for the desk including a head part being secured to the lower face of the desk at right angles to and formed with a gullet for the passage of said bar, said head provided with a pair of oppositely extending arms secured to said vertical flange, and a stationary combined carrying, receiving and supporting structure for said means including a forwardly inclined channel-shaped portion in which said shank is slidably mounted, and a clamping device having a part mounted in said shank and a plurality of elements carried by said portion and coacting with said part for clamping the shank stationary to the said portion.

U.S. Pat. No. 2,184,173

Inventor: William J. Bargen

Issued: Dec. 19, 1939

In a structure for coupling an upper element to a lower element and for supporting the upper element in spaced forwardly extending relation with respect to the lower element, said structure including a member formed of an upstanding arm and a horizontally disposed lower arm extending inwardly at right angles from the lower end of the upstanding arm and a horizontally disposed lower arm extending inwardly at right angles from the lower end of the upstanding arm, the latter being formed intermediate its ends with an inclined part, an upper connection means adapted to be anchored to the lower face of the said upper element, said upstanding arm having an upper straight portion extended into and being secured to said means, said lower arm being formed at a horizontal and a vertical flange, and a lower connection means adapted to be anchored against the lower face of the vertical flange, and a lower connection means adapted to be anchored against the lower face of the lower element and bearing against the lower face of the horizontal flange and inner face of the vertical flange.

U.S. Pat. No. 2,258,532

Inventor: William J. Bargen

Issued: Oct. 7, 1941

In a desk including a seat and a top, means supporting said top relative to the seat comprising an inner and outer tubular member disposed in telescopic relation, said outer member being stationary, said inner member being lengthwise shiftable relative to the outer member, means for securing the lower end of the outer member, means for securing the lower end of the outer member of said seat, means for securing the upper end of the inner member to one side of said top, interengageable teeth within said supporting means being arranged on opposed faces of said members for sustaining the inner member in adjusted position, said inner member being slotted, and clamping means including parts arranged in said inner member and slot and parts arranged in said outer member and threadedably engaging with the said other parts for clamping other opposed faces of said members together for securing said inner member in adjusted position relative to said outer member.

U.S. Pat. No. 2,319,202

Inventor: William J. Bargen

Issued: May 18, 1943

In a school desk including a pedestal base having a U-shaped upper portion, a combined seat and back, a combined supporting plate for supporting and attaching the combined seat and back to the upper portion of the base, said plate including a U-shaped member having the parallel legs thereof longer than the legs of said upper pedestal portion, a pair of eats extending from the right portion of said plate to said upper pedestal portion, and means securing said combined seat and back to said ears and the end portions of the legs of said plate.

U.S. Pat. No. 2,764,229

Inventor: William J. Bargen

Issued: Sep. 25, 1956

A combination seat support and desk bracket comprising a seat support member, a base engaging member formed integrally with said seat support member and extending substantially perpendicularly thereto, said base engaging member having a substantially C-shaped cross-section, an arm extending laterally of said seat support member and an upstanding desk bracket formed integrally with said arm and extending oppositely of said base engaging member.

U.S. Pat. No. 4,455,008

Inventor: James MacKew

Issued: Jun. 19, 1984

A modular arrangement for supporting any one of a wide variety of sizes of reading and other materials at a freely selectable location in relation to any selected one of a wide variety of local environments, such as chairs, sofas, tables and the like is disclosed and includes an expansible reading material holding assembly along with a plurality of support mechanisms each accepted for attachment to a different class of local environment and an arrangement for coupling the holding assembly to a select one of the support mechanisms to provide limited manual adjustability of the elevation of the holding assembly relative to the selected support mechanism as well as a limited amount of manual adjustability of the holding assembly, from vertical to horizontal, as may be preferenced by the various users. In the horizontal attitude the holding assembly functions as a table. The coupling means may include an articulated arm comprising a pair of arm members journaled together at respective first ends for unrestricted angular movement in a generally horizontal plane with one of the arms having its second end pivotably attached to the support mechanism and the other of the arms having its second end pivotably supporting the material holding assembly. The material holding assembly may include lateral extension portions and telescopic risers movable in generally orthogonal directions to expand and contract the reading material support area.

U.S. Pat. No. 5,573,301

Inventor: Donald G. Scott

Issued: Nov. 12, 1996

The present device is an improved table for attachment to the frame of a chair. The improved table comprises, in general, a table top including a first table top half and a second table top half; cooperative holding devices for holding the table halves together to establish a unitary condition of the table top; a first crank for rotatably supporting the first table top half for rotation about a first substantially vertical axis; a first mounting tube for rotatably supporting the first crank for rotation about a second substantially vertical axis offset from the first vertical axis, a first bracket for attaching the first mounting tube to the frame of the chair; a second crank for rotatably supporting the second table top half for rotation about a third substantially vertical axis; a second mounting tube for rotatably supporting the second crank for rotation about a fourth substantially vertical axis offset horizontally from the third vertical axis, and a second bracket for attaching the second mounting tube to the frame of the chair. The dimensions of the components of the table and the distances between certain pivot axes can be selected so that parallel movement of the table top can be accomplished. However, if the dimensions of the chair are such that will not permit the above mentioned dimensions to be selected, under certain conditions the table top may be moved from a forward most position to a rearward most parallel position by skewing the table top as it is moved.

U.S. Pat. No. 6,412,862

Inventor: Randy Wayne Dickerson et al.

Issued: Jul. 2, 2002

An assembly for mounting a table, tray or other removable component to a chair to support a laptop computer or other appliance includes a socket that can be permanently mounted in the chair arm and a bracket or mounting assembly that can be mounted on the bottom of the removable component. The socket includes a sleeve with a collar mounted on the top of the sleeve. The collar surrounds the area around a hole in the chair arm through which the socket sleeve extends. The sleeve is attached to an internal frame member. A spring biased plug shifts within a cavity in the sleeve. A rigid pin located on the bottom of the removable component is inserted through a central opening in the collar into the cavity, forcing the plug into the sleeve. The table is firmly supported by the socket, but it is free to rotate in a horizontal plane.

U.K. Patent Number GB 724,315

Inventor: Kenneth John Morison

Issued: Feb. 16, 1955

A tray 5 is supported on a chair arm, bed-rail or other support by a pair of adjustable bent arms 1 and has one or a pair of detachable telescopic legs 6 mounted in rear sockets 4. One or more straps 11 with weighted ends may assist retention or can be used to hold a book on the tray.

U.K. Patent Number GB 2 327 600 A

Inventor: George Babatunda Babalola

Issued: Feb. 16, 1955

A device for supporting a book comprises a book support in the form of a board 2 with a shelf 4 and a clip 3, a mounting plate 5 and an extensible arm 6. The extensible arm is hinged to the book support by a bushing which enables the book support to be adjusted to the convenience of the user. When in use the plate 5 may be mounted on a wall beside a bed or chair and an open book can be placed on the board with the bottom of the book resting on the shelf and the top of the book held in clip 3. The device may also be used for writing as well as reading. It can be folded away when unused by contracting the arm 6.

While these chair/desk combinations may be suitable for the purposes for which they were designed, they would not be as suitable for the purposes of the present invention, as hereinafter described.

SUMMARY OF THE PRESENT INVENTION

The present invention discloses a mathematically-based game comprising a game board having four parallel rows of eight depressions for retaining game pieces such as marbles. Game pieces are arranged by each player in the depressions which are disposed within their area of play. The players then sequentially manipulate the game pieces around the game board according to mathematical calculations with the objective of eliminating all of the opponent's game pieces. The present invention requires the user to apply addition, subtraction, thinking and reasoning thereby promoting the concentration, creativity and problem-solving abilities of the players.

A primary object of the present invention is to provide a board game comprising a playing board having four parallel rows of eight depressions for holding game pieces during play.

Another object of the present invention is to provide a board game wherein each player has the two rows nearest them designated as their area of play.

Yet another object of the present invention is to provide a board game wherein each player initially has two game pieces residing in each depression in their area of play.

Still yet another object of the present invention is to provide a board game wherein play is initiated by each player rearranging their 32 game pieces within the depressions located in their play area according to their choosing.

Another object of the present invention is to provide a board game wherein the players use addition, subtraction, thinking and reasoning to calculate the movement of the game pieces into the play area of the opponent with the objective to eliminate all of the opponents game pieces.

Another object of the present invention is to provide a chair/desk combination that is simple and easy to use.

Yet another object of the present invention is to provide a chair/desk combination that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

LIST OF REFERENCE NUMERALS

Figure 1:
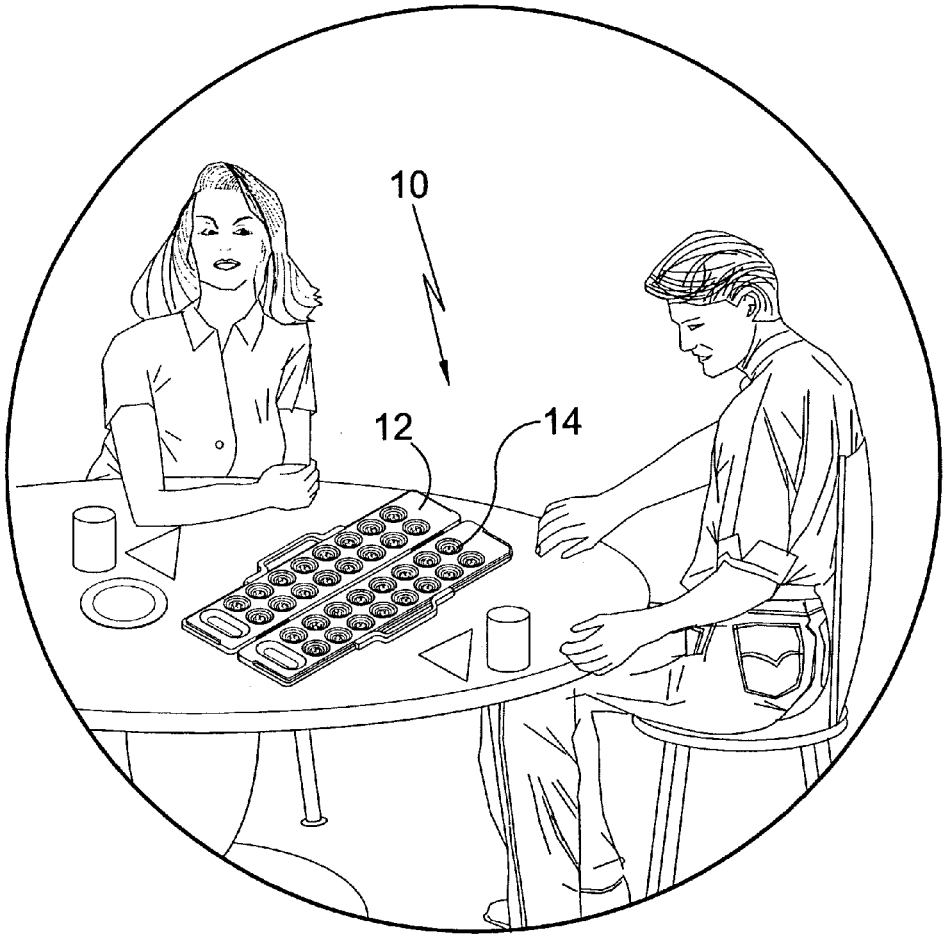
FIG. 1 is an illustrative view of the present invention in use.

With regard to reference numerals used, the following numbering is used throughout the drawings.

10 present invention
12 board
14 cavity
16 first half
18 second half
20 hinge
22 pocket
24 game piece
26 player
28 handle
30 table top

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a game and game board 12 having parallel rows of depressions or pockets 14 providing means for easily inserting and removing objects therefrom; a game having pieces and rules that culminate in one player capturing all of opponents pieces.

Figure 2:
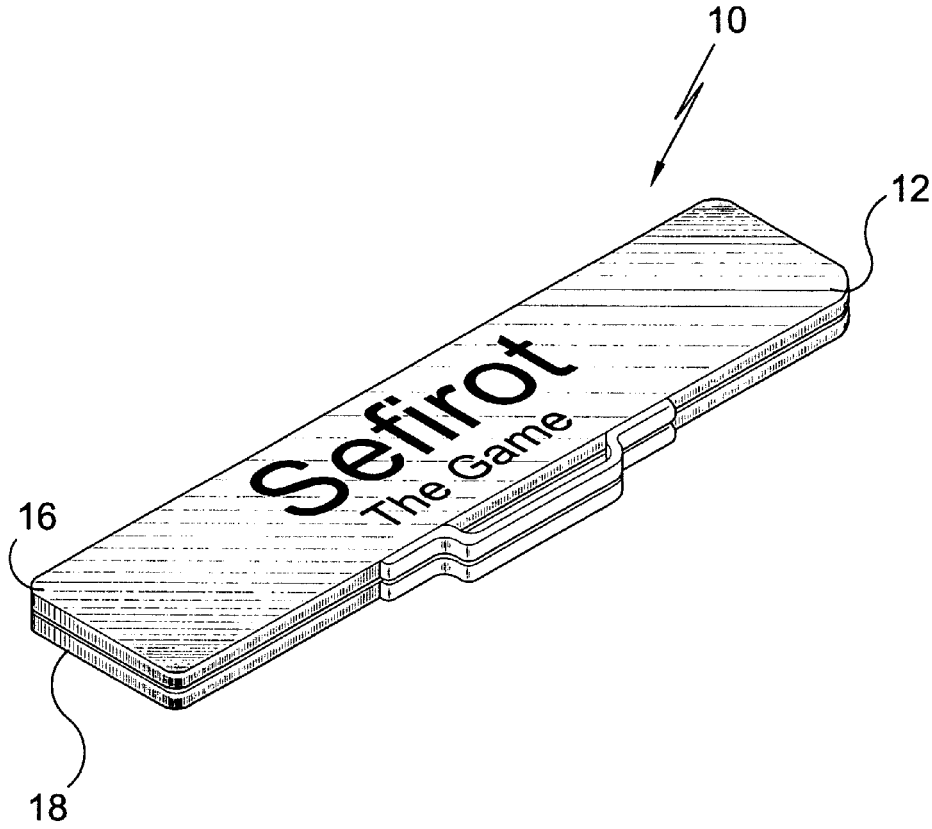
FIG. 2 is a perspective view of the present invention in the closed position.

Turning to FIG. 2, shown therein is a perspective view of the present invention 10 in the closed position. Shown is the present invention 10 disclosing a game and game board 12 having parallel rows of depressions or pockets and movable marbles as playing pieces. Each row comprises eight depressions or pockets per row, sixteen per parallel set per player and total thirty-two depressions. The board 12 comprises two halves 16, 18 each having sixteen depressions and foldably attached to each other by means of hinges. Each player has one side of the board 12. The game is a mathematical game that involves interpersonal interaction between two players.

Figure 3:
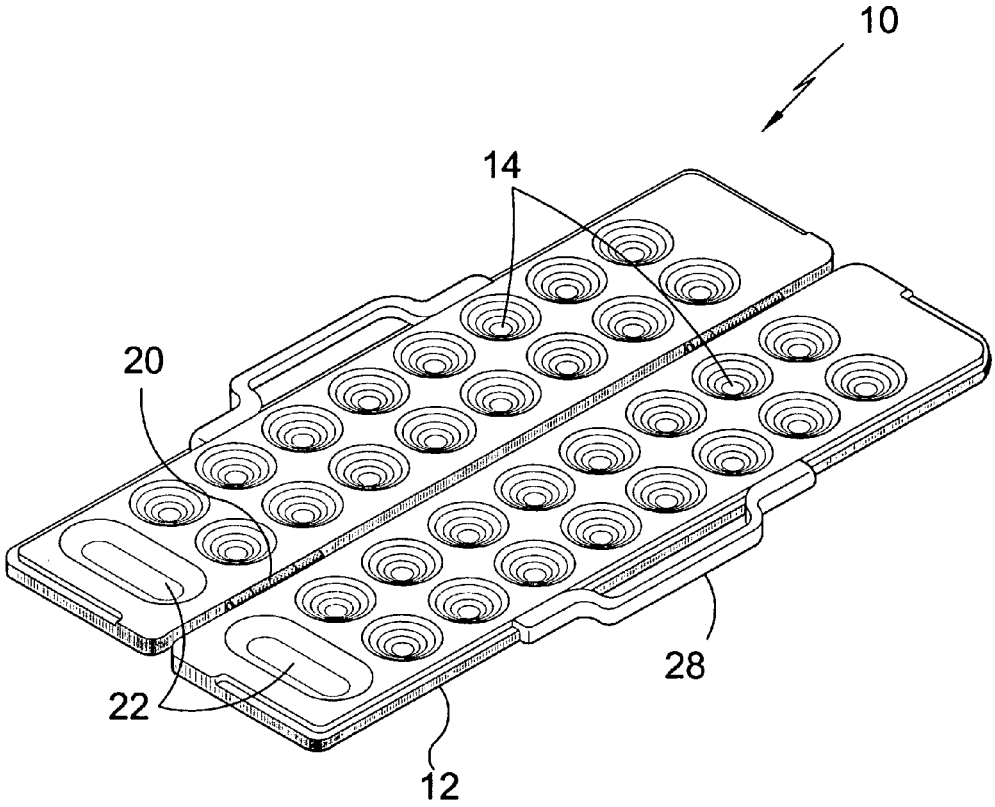
FIG. 3 is a perspective view of the present invention in the open position.

Turning to FIG. 3, shown therein is a perspective view of the present invention 10 in the open position. Shown is the present invention 10 disclosing a game and game board 12 having parallel rows of depressions, cavities or pockets 14 and movable marbles as playing pieces. Each row comprises eight depressions or pockets 14 per row, sixteen per parallel set per player and total thirty-two depressions. The board 12 comprises two halves each having sixteen depressions and foldably attached to each other by means of hinges 20 on the inner edges. Each player has one side of the board 12. The game is a mathematical game that involves interpersonal interaction between two players. Also shown are game piece pockets 22 adjacent the bottom edge extending substantially from the inner edge to the outer edge for temporary storage of the game pieces. Handles 28 are shown on the outer edges.

Figure 4:
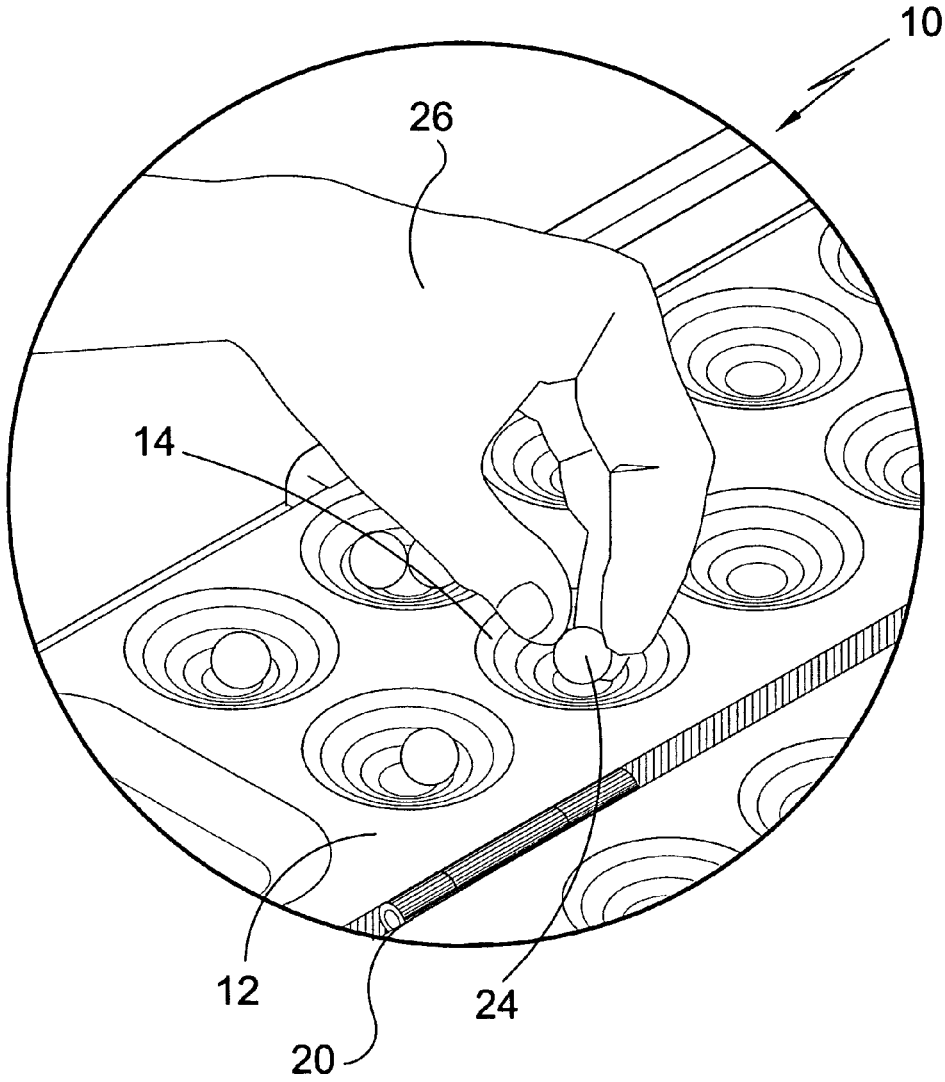
FIG. 4 is a detailed view of the present invention.

Turning to FIG. 4, shown therein is a detailed view of the present invention 10. Shown is the present invention 10 disclosing a game and game board 12 having parallel rows of depressions or pockets 14 and movable marbles as playing pieces 24. Each row comprises eight depressions or pockets 14 per row, sixteen per parallel set per player and total thirty-two depressions. The board 12 comprises two halves each having sixteen depressions and foldably attached to each other by means of hinges 20. Each player 26 has one side of the board 12. The game is a mathematical game that involves interpersonal interaction between two players.

Figure 5:
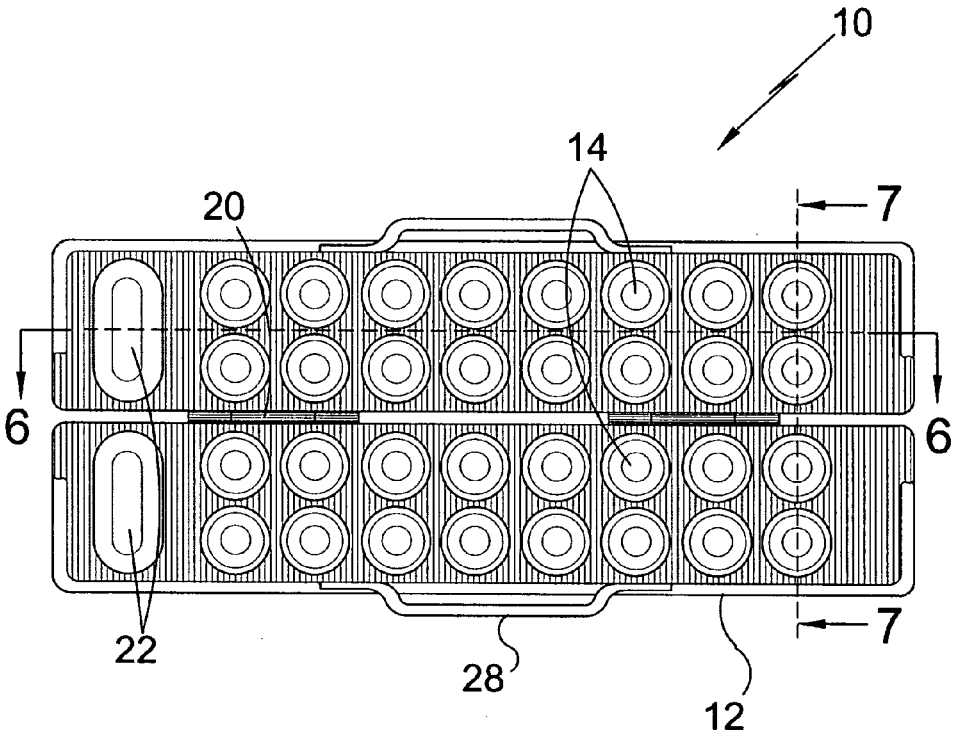
FIG. 5 is a planar view of the present invention.

Turning to FIG. 5, shown therein is a planar view of the present invention 10. Shown is the present invention 10 disclosing a game and game board 12 having parallel rows of depressions or pockets 14 and movable marbles as playing pieces. Each row comprises eight depressions or pockets 14 per row, sixteen per parallel set per player and total thirty-two depressions. The board 12 comprises two halves each having sixteen depressions and foldably attached to each other by means of hinges 20. Each player has one side of the board 12. The game is a mathematical game that involves interpersonal interaction between two players. Also shown are handle 28 and pocket 22.

Figure 6:
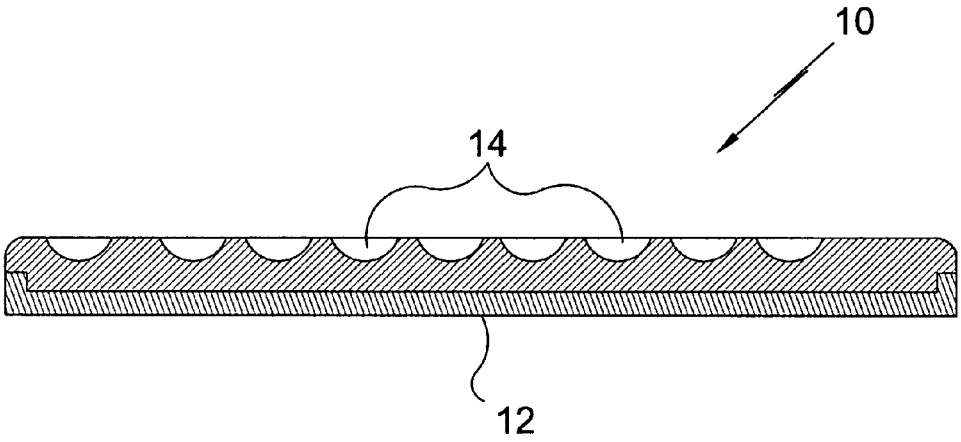
FIG. 6 is a cross sectional view of the present invention.

Turning to FIG. 6, shown therein is a cross sectional view of the present invention 10. Shown is the present invention 10 disclosing a game and game board 12 having parallel rows of depressions or pockets 14 and movable marbles as playing pieces. Each row comprises eight depressions or pockets 14 per row, sixteen per parallel set per player and total thirty-two depressions. The board 12 comprises two halves each having sixteen depressions and foldably attached to each other by means of hinges. Each player has one side of the board 12. The game is a mathematical game that involves interpersonal interaction between two players.

Figure 7:
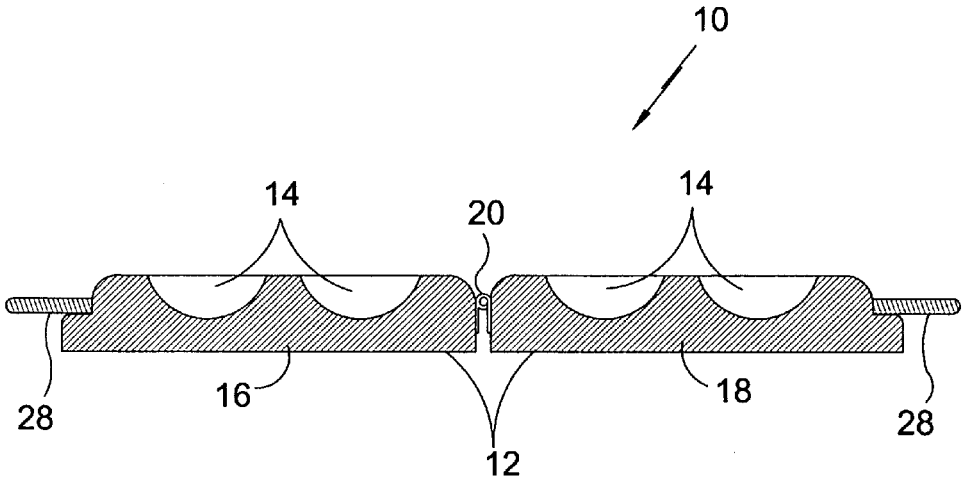
FIG. 7 is a cross sectional view of the present invention.

Turning to FIG. 7, shown therein is a cross sectional view of the present invention 10. Shown is the present invention 10 disclosing a game and game board 12 having parallel rows of depressions or pockets 14 and movable marbles as playing pieces. Each row comprises eight depressions or pockets 14 per row, sixteen per parallel set per player and total thirty-two depressions. The board 12 comprises two halves 16,18 each having sixteen depressions and foldably attached to each other by means of hinges 20. Each player has one side of the board 12. The game is a mathematical game that involves interpersonal interaction between two players. Also shown are handles 28.

Figure 8:
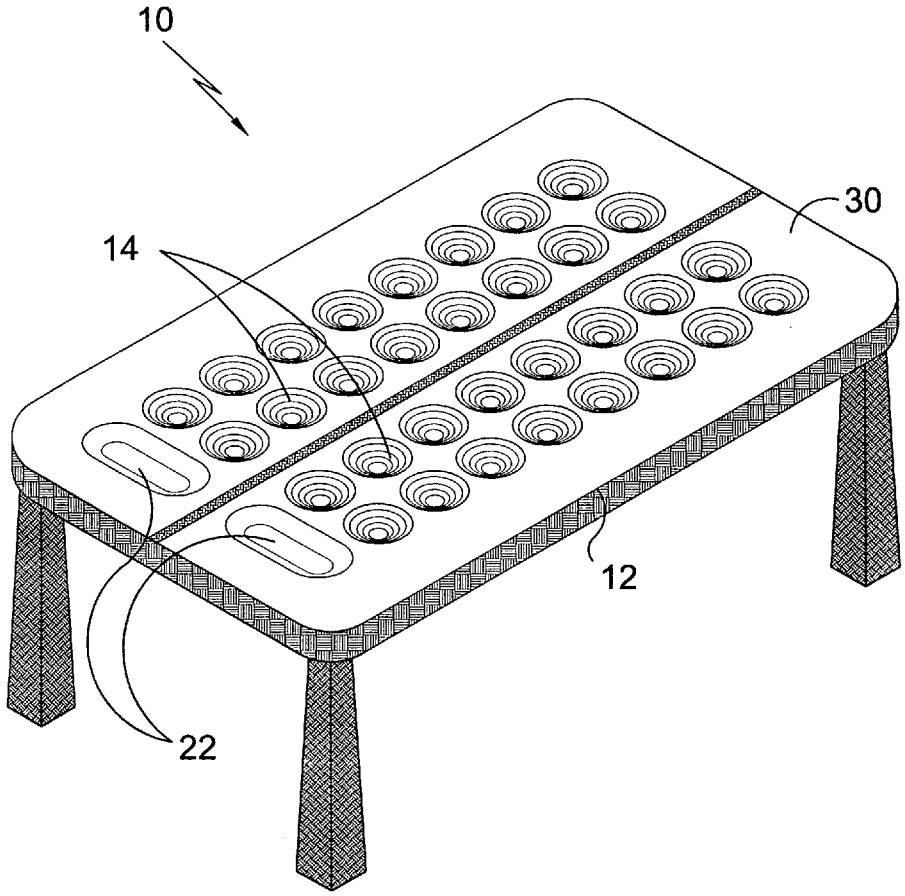
FIG. 8 is a perspective view of the present invention integrated within a tabletop.

Turning to FIG. 8, shown therein is a perspective view of the present invention 10 integrated within a tabletop 30. The present invention 10 may be adapted to suit a variety of physical configurations such as an ornate tabletop 30 or portable, folding unit as long as the set-up of the game board 12 and the rules of game play remain consistent within the parameters previously described. Also shown are cavities 14 and pockets 22.

What is claimed to be new and desired to be protected by Letters Patent is set forth in the appended claims.

I claim:

1. A game board, consisting of:

a) said game board having first and second rectangular shaped halves, each of said first and second halves having top and bottom surfaces and adjacent first sides being hinged together so that said halves can be folded toward each other, said first and second halves each having a second side opposite said first side, wherein said top surfaces of said first and second halves are contiguous to each other when said halves are folded toward each other, each of said rectangular shaped halves having first and second ends at right angles to said sides;

b) two parallel rows of eight depressions each only being disposed in said top surface of each of said first and second halves so that each said depression can receive a game piece, said rows being parallel to said first and second sides;

c) a pocket being disposed on each top surface between the first end of each of said halves and an end of said rows so that each said pocket can receive a plurality of game pieces for temporary placement thereof;

d) a shoulder formed along each second side and extending around to adjacent ends and ending before reaching said first side, each shoulder coming together when said halves are folded together forming a slot around three sides of the folded game board;

e) a handle mounted on each of said second sides on said shoulder, each handle together when said halves are folded together, the two handles forming a single handle;

f) said recesses being substantially spherical in shape; and g) said top surfaces having no other recesses formed therein.

2. The apparatus of claim 1, wherein said game pieces are marbles.

* * * * *